US010632036B2

(12) United States Patent
Hampe et al.

(10) Patent No.: US 10,632,036 B2
(45) Date of Patent: Apr. 28, 2020

(54) DEVICE FOR ALIGNING AND CONNECTING A HOOD TO A HOUSING

(71) Applicant: Drägerwerk AG & Co. KGaA, Lübeck (DE)

(72) Inventors: Markus Hampe, Lübeck (DE); Robert Lischinski, Einhaus (DE); Tjeerd Jan Pieter Gerbranda, Blaustein (DE); Eduard Engelsman, Lübeck (DE); Danker Kemper, Delft (NL)

(73) Assignee: Drägerwerk AG & Co. KGaA, Lübeck (DE)

( * ) Notice: Subject to any disclaimer, the term of this patent is extended or adjusted under 35 U.S.C. 154(b) by 55 days.

(21) Appl. No.: 15/606,403

(22) Filed: May 26, 2017

(65) Prior Publication Data

US 2017/0340500 A1 Nov. 30, 2017

(30) Foreign Application Priority Data

May 30, 2016 (DE) ..... 10 2016 006 371

(51) Int. Cl.
*A61G 11/00* (2006.01)

(52) U.S. Cl.
CPC ..... *A61G 11/006* (2013.01); *A61G 11/005* (2013.01); *A61G 11/007* (2013.01); *A61G 2203/78* (2013.01); *A61G 2210/90* (2013.01)

(58) Field of Classification Search
CPC .. A61G 11/006; A61G 11/007; A61G 11/005; A61G 2210/90; A61G 2203/78
USPC ..... 600/21–22; 128/897–899
See application file for complete search history.

(56) References Cited

U.S. PATENT DOCUMENTS 3,782,362 A * 1/1974 Puzio ..... A61G 11/00 128/205.26
4,121,571 A * 10/1978 Pickering ..... A61G 11/00 128/204.17
4,221,211 A * 9/1980 Brasch ..... A61G 7/1019 128/205.26
4,334,629 A * 6/1982 Koch ..... A61G 11/00 220/252
5,971,914 A * 10/1999 Donnelly ..... A61G 11/00 600/22
6,231,499 B1 * 5/2001 Jones ..... A61G 11/00 600/22

(Continued)

FOREIGN PATENT DOCUMENTS

CN 104220036 A 12/2014
CN 204379648 U 6/2015

(Continued)

*Primary Examiner* — Navin Natnithithadha
*Assistant Examiner* — Sunita Reddy
(74) *Attorney, Agent, or Firm* — McGlew and Tuttle, P.C.

(57) ABSTRACT

A device (4) aligns and connects a housing hood (3) to a housing (2). The device (4) has a first connecting piece (5) and a second connecting piece (6). The first connecting piece (5) has a clamp bearing element (51) and the second connecting piece (6) has a lamella element (61). The lamella element (61) is arranged movably along the clamp bearing element (51). The device (4) has a clamping element (7) for clearance-free clamping the lamella element (61) with the clamp bearing element (51). An alignment of the hood (3) on a housing (2) can be carried out simply and rapidly and requires only weak clamping forces.

19 Claims, 6 Drawing Sheets

(56) References Cited

U.S. PATENT DOCUMENTS

| | | | | |
|---|---|---|---|---|
| 6,893,390 | B1 * | 5/2005 | Mackin | A61G 11/00 5/603 |
| 2002/0143233 | A1 * | 10/2002 | Donnelly | A61G 11/00 600/22 |
| 2003/0045773 | A1 * | 3/2003 | Costanzo | A61G 11/00 600/22 |
| 2005/0020872 | A1 * | 1/2005 | Hampe | A61G 11/00 600/22 |
| 2005/0070756 | A1 * | 3/2005 | Falk | A61G 11/00 600/22 |
| 2007/0001076 | A1 * | 1/2007 | Asamarai | F16M 11/10 248/281.11 |
| 2008/0072399 | A1 * | 3/2008 | Krajenke | E05D 7/0423 16/238 |
| 2010/0076248 | A1 * | 3/2010 | Ibara | A61G 11/00 600/22 |
| 2010/0286471 | A1 * | 11/2010 | Matsubara | A61G 11/00 600/22 |
| 2015/0065787 | A1 * | 3/2015 | Bohnen | A61G 11/00 600/22 |
| 2016/0081582 | A1 * | 3/2016 | Rapoport | G01R 33/30 600/415 |

FOREIGN PATENT DOCUMENTS

| | | | |
|---|---|---|---|
| DE | 10 2008 056 430 | B3 | 2/2010 |
| DE | 10 2012 006 204 | A1 | 10/2013 |

* cited by examiner

DEVICE FOR ALIGNING AND CONNECTING A HOOD TO A HOUSING

CROSS REFERENCE TO RELATED APPLICATIONS

This application claims the benefit of priority under 35 U.S.C. § 119 of German Application 10 2016 006 371.8, filed May 30, 2016, the entire contents of which are incorporated herein by reference.

FIELD OF THE INVENTION

The present invention pertains to a device for aligning and connecting a hood to a housing, the device having a first connecting piece and a second connecting piece.

BACKGROUND OF THE INVENTION

A housing-hood system may have a guided hood. A guided hood is placed on the housing with a guide mechanism and closes the housing. A guide mechanism may be, for example, a hood arm, which is permanently connected to the housing. When pivoting up, the hood can be placed very far away from the housing. The hood must be placed fittingly on the housing with the guide mechanism to close the housing correctly. In case of a guided motion of the hood, the hood also remains connected to the housing after pivoting up from the housing in a guided manner and can then be placed again in the housing with a guided motion. Based on the tolerances of the individual components of the guide mechanism, it is necessary to align the hood with the housing before putting the housing-hood system into operation. The connection of the hood to the housing forms a mechanical coupling, which shall compensate positional tolerances and oblique positions.

It is known in this connection that housing-hood systems can be provided which have no possibilities of adjustment and are permanently assembled with one another. The drawback of these devices is the high cost of manufacturing the individual components, because these components must be manufactured with very high precision, so that the manufacture is complicated and expensive because of high tolerance requirements and there are high reject rates in case of deviations from the tolerances.

It is further known that adjusting screw connections, for example, an adjustable height of the housing contact surface, can be provided on individual components of the housing-hood system. The drawback of this is the complicated adjustment during the final assembly. This is, furthermore, very time-consuming and may possibly comprise an expensive adjusting mechanism, adjusting devices or measuring technique.

Further, ball head systems are known, in which the hood is aligned with the housing and connected to the housing by means of a ball head system. These systems have the drawback that very strong clamping forces are necessary for fixing the head system and only rotational degrees of freedom are adjustable.

A housing-hood system in the form of a thermotherapy device is known from DE 10 2012 006 204 A1. The hood is connected to the housing via a hood arm. The hood can be adjusted via a clamp connection, which extends around a bolt of the hood arm with clamps. It was found that only a limited alignment of the hood, namely, only a rotational degree of freedom and a translatory degree of freedom, are possible with this device, and that strong clamping forces are necessary.

SUMMARY OF THE INVENTION

An object of the present invention is therefore to provide a device that can be operated simply, reversibly and rapidly for aligning a hood and only requires weak clamping forces.

Provisions are made in a device mentioned at the beginning for the first connecting piece to have a clamp bearing element and for the second connecting piece to comprise a lamella element (blade element/slat element), the lamella element being arranged movably along the clamp bearing element and the device having a clamping element for clamping the lamella element with the clamp bearing element in a clearance-free manner (clearance-free).

The device for aligning and connecting a hood to a housing is connected to the hood with one of the two connecting pieces and to an element of the housing with the other connecting piece. A clamp bearing element, which brings about the connection between the two connecting pieces and hence between the hood and the housing with a lamella element, is provided here at one of the connecting pieces. The lamella element can be displaced continuously at the clamp bearing element. The lamella element and hence the corresponding connecting piece can thus be aligned at the other connecting piece. A hood can be aligned with a housing in this manner. If the lamella element or the hood was aligned into the correct position, it is clamped with the clamping element at the clamp bearing element without clearance. The lamella element is fixed now. The connecting piece and hence also the hood are thus also fixed at the housing in the position in which the hood is seated correctly on the housing. When the connecting pieces are mounted on the hood and on the housing element, only the hood needs to be placed on the housing. A continuous self-adjustment of the hood now takes place, because the lamella element is attached to the clamp bearing element corresponding to the position of the hood. The lamella element is clamped in this position with the clamp bearing element, so that the correct position is automatically selected for the hood on the housing during the assembly. A device that can be aligned easily and rapidly and which can be rapidly fixed is thus provided. Further, the device makes possible the self-centering of the hood on the housing. The alignment of the hood on the housing is simplified by the self-centering.

The clamping may be performed here permanently or detachably. A permanent clamping is defined here, for example, as welding or bonding. A detachable clamping is defined as a clamping by means of, for example, wedges, clamping tools or screws.

The clamping element is advantageously configured for the detachable clamping of the lamella element with the clamp bearing element. The hood can be detached from the housing at any time simply and rapidly by means of the detachable clamping by means of the clamping element. Repair and maintenance procedures as well as transportation of the housing-hood system, which is carried out without the hood, can be carried out simply and rapidly in this manner.

Further, the lamella element advantageously has clearance in a single plane in a state in which it is arranged on the clamp bearing element. The lamella element can thus only be displaced in a single plane relative to the clamp bearing element. The clearance of the lamella element relative to the clamp bearing element makes possible an alignment of the hood on the housing in two directions in space and about an axis of rotation that is at right angles to the plane.

The second connecting piece advantageously has a receiving part for receiving a hood fastening rod, the receiving part being connected to the lamella element. The device can be connected to a hood arm of a housing or to a hood by means of the receiving part by arranging the hood fastening rod in the receiving part. The hood fastening rod may, for example, be passed simply through the receiving part and thus be received by the receiving part. The receiving part may also be connected to the clamp bearing element at the first connecting piece. The second connecting piece is connected in this case to the hood and the first connecting piece to the housing.

It is further advantageous if the receiving part receives a hood fastening rod with clearance, and, further, a fixing element is arranged on the receiving part for the clearance-free fixation of the hood fastening rod on the second connecting piece. The fixing element is preferably configured as a clamping ring element. A hood fastening rod can be arranged with clearance on the device by means of the receiving part. The receiving part permits a displacement of the hood fastening rod received at right angles to the plane in which the lamella element has clearance along the clamp bearing element. The third direction in space, namely, the direction in space at right angles to the plane in which the lamella element has clearance, is thus covered for the alignment of the hood in a simple manner. Due to the clearance that the hood fastening rod has relative to the receiving part and hence relative to the second connecting piece of the device, the hood fastening rod can thus be aligned relative to the device in two axes of rotation located in the plane and aligned in a direction in space that is at right angles to the plane if the hood fastening rod is received by the receiving part. The hood fastening rod can be fixed without clearance on the second connecting piece by means of the fixing element, so that it no longer has any clearance. A position of the hood fastening rod relative to the device can thus be "frozen." Due to the combination with the range of motion of the lamella element, the hood can thus be aligned relative to the housing when the hood is connected to the housing via the device. Due to the blocking of the clearance of the lamella element and of the hood fastening rod, the alignment of the hood relative to the housing can be fixed. All six degrees of freedom can thus be utilized with simple fixation or alignment of the hood.

The receiving part further preferably has a groove-and-tongue combination with a receiving groove and with a receiving tongue for holding a hood fastening rod with fitting groove and tongue combination. The hood fastening rod cannot thus be rotated relative to the receiving part. Such a rotary motion is permitted by the mobility of the lamella along the plane at the clamp bearing element. Double coverage of the rotational degree of freedom of the hood fastening rod is avoided in this manner. The alignment of a hood, which is connected with a hood fastening rod to a housing, is facilitated hereby.

The receiving part is advantageously made in one piece with the lamella element. A manufacturing step is thus eliminated and the reliability of the connection between the receiving part and the lamella element is increased.

Further, it is advantageous if the first connecting piece has clamp bearing elements located at mutually spaced locations from one another, the second connecting piece having lamella elements located at mutually spaced locations from one another, which are associated with one of the clamp bearing elements each. Clamp bearing elements arranged at mutually spaced locations from one another make possible a connection between the first connecting piece and the second connecting piece in positions located at mutually spaced locations from one another. This makes possible an increased reliability of the fastening of the first connecting piece to the second connecting piece. In a first preferred embodiment, two clamp bearing elements are provided with two lamella elements, which can be clamped together by two clamping elements, which bring about a clamping together of the respective lamella elements with the respective clamp bearing element. In a second preferred embodiment, the clamping element is configured to clamp together all lamella elements all at once with the respective clamp bearing element. The clamping together of all lamella elements on the clamp bearing element can thus be carried out in only one step.

The first connecting piece advantageously has an intermediate lamella element with a lamella element guide element, which is guided at a guide rail element at the first connecting piece, the intermediate lamella element being able to be clamped together with the lamella element by means of the clamping element and being connected by a material connection, preferably welded, to the guide rail element. The lamella element is thus clamped by means of the intermediate lamella element between the clamp bearing element and the intermediate lamella element. The number of contact surfaces that make a contribution to the static friction with which the lamella element is clamped on the first connecting piece is increased hereby. This increases the holding force of the connection between the first connecting piece and the second connecting piece, so that a weaker force is needed for the clamping together than in the case of fewer contact surfaces. This leads to a further increase in the reliability of clamping and simplifies the alignment of the hood at the housing.

The second connecting piece advantageously has at least one additional lamella element, which is arranged movably at the intermediate lamella element, the additional lamella element being able to be clamped with the intermediate lamella element without clearance. An additional intermediate lamella element is preferably provided for each additional lamella element at the first connecting piece. The number of contact surfaces that contribute to the friction can thus be increased greatly and the reliability of clamping can thus be increased further. Furthermore, the mounting and the alignment of the hood in the housing is additionally simplified.

The clamping element is advantageously configured as a clamping screw, and the clamp bearing element has a clamp bearing for receiving the clamping element. Further, the intermediate lamella element preferably has a clamping element hole for the clamping screw, which latter hole is aligned with the clamp bearing hole, so that the clamping screw can be guided by the intermediate lamella element. Due to the clamping element being configured as a clamping screw, the clamping together can be brought about by actuating the clamping screw in a simple manner and without major effort. The clamping screw can now mesh with a thread on the clamp bearing element or be guided through the hole in the clamp bearing element and act on the opposite side by means of an opposed bearing in the form of, for example, a fitting nut. Further, a plurality of clamping screws and correspondingly a plurality of holes may also be provided on the clamp bearing element and/or on the intermediate lamella element.

The lamella element advantageously has a recess, whose edge extends circumferentially around the clamp bearing hole at least partially in a state in which it is arranged at the clamp bearing element. The recess on the lamella element is configured such that the lamella element has clearance if a screw is passed through the hole. Sufficient friction surface now remains for the clamping together, so that the strength of the clamping of the lamella element decreases only insignificantly at equal clamping force.

The present invention further pertains to a preassembly system comprising the above-described device, the device having at least two lamella elements and a centering device for centering the lamella elements in relation to one another.

The preassembly system offers the advantage that the device can be preassembled and can be mounted in a simple manner as a result. The lamella elements are centered with one another by means of the centering device during the preassembly. The lamella elements are then connected to the first connecting piece via the clamping together. The second connecting piece can thus be connected to the housing-hood system without a major effort. The clamping together can be unclamped after the connection of the connecting piece to the housing-hood system, so that the hood can be aligned on the housing. The clamping together can again be established after the alignment.

The centering device advantageously has the form of a hood fastening rod. The centering device may further advantageously have a centering device cone end piece and a centering device groove extending along a longitudinal direction of the centering device with a centering device bevel arranged at the centering device cone end piece. The centering device bevel at the centering device groove makes possible a simple insertion of the centering device into the part. Precisely if the centering device must be passed through a plurality of receiving parts, the receiving parts are precentered by the centering device cone end piece and the centering device bevel and guided fittingly onto the centering device. The receiving tongues are further passed through the centering device bevel and into the centering device groove. The use of the centering device is simplified hereby.

Further, the present invention pertains to a thermotherapy device comprising a housing, a hood and a device for aligning and connecting the hood to the housing as described above.

The housing advantageously comprises here a hood arm with a hood fastening rod. The hood fastening rod may advantageously have a hood fastening rod cone end piece and a hood fastening rod groove extending along a longitudinal direction of the hood fastening rod with a hood fastening rod bevel arranged at the hood fastening rod cone end piece. The advantages of the hood fastening rod cone end piece and of the hood fastening rod bevel of the hood fastening rod are analogous to the above-described advantages of the centering device.

Further, the device is advantageously enclosed at the thermotherapy device by a cover part, which is preferably formed from two half shells. This avoids clamping of body parts or clothes of the operating staff or of visitors of the patient at the device.

The device advantageously has a cover element, which is arranged on the hood fastening rod and is supported on the hood arm with a spring force acting along the hood fastening rod. The cover element is mounted longitudinally displaceably on the hood fastening rod. Further, the cover element is pressed hereby onto the cover part of the device along the hood fastening rod in the compressed state. A lateral opening of the cover part, which was passed through by a displacement of the hood fastening rod along the rod axis and at right angles to the plane, is thus closed by the cover element regardless of the exact axial position in which the device is fixed on the hood fastening rod. The device is thus protected from the entry of contamination and corrosive media. Further, jamming of body parts or clothing of the operating staff or visitors of the patient is prevented by the cover element.

The present invention will be explained in more detail below on the basis of an advantageous exemplary embodiment by means of the attached drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1A:
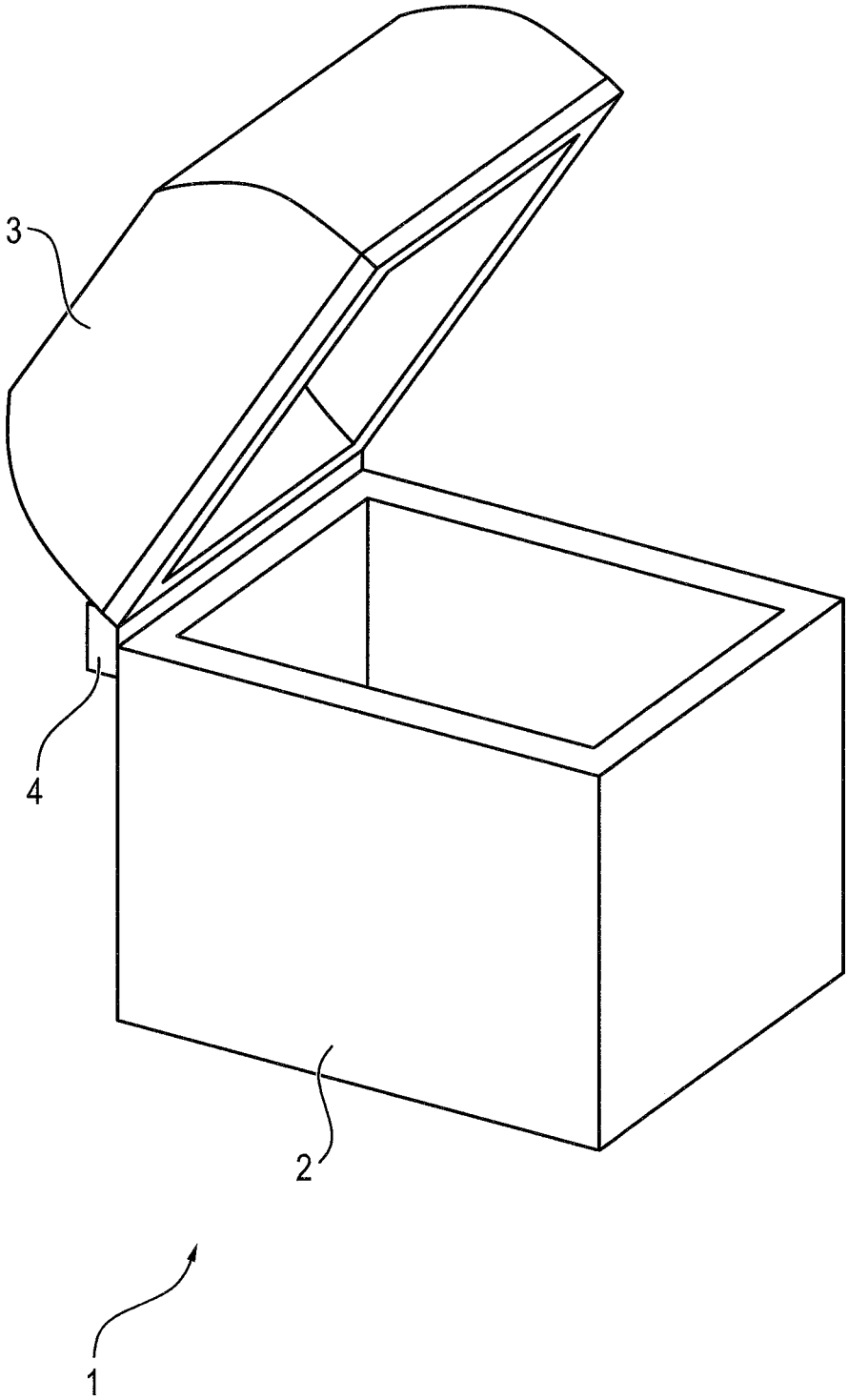
FIG. 1*a* is a schematic perspective view of a housing-hood system.

Referring to the drawings, FIG. 1*a* shows a housing-hood system, which is referenced in its entirety by the reference number 1. The housing-hood system 1 comprises a housing 2 and a hood 3. The hood 3 is used to cover and to close the housing 2. The hood 3 is connected to the housing 2 by means of a device 4 for connection and alignment. The hood 3 can be raised from the housing 2 by means of a guided motion in order to open the housing 2. Further, the hood 3 can correspondingly be lowered onto the housing 2 by means of a guided motion in order to close the housing 2.

Figure 1B:
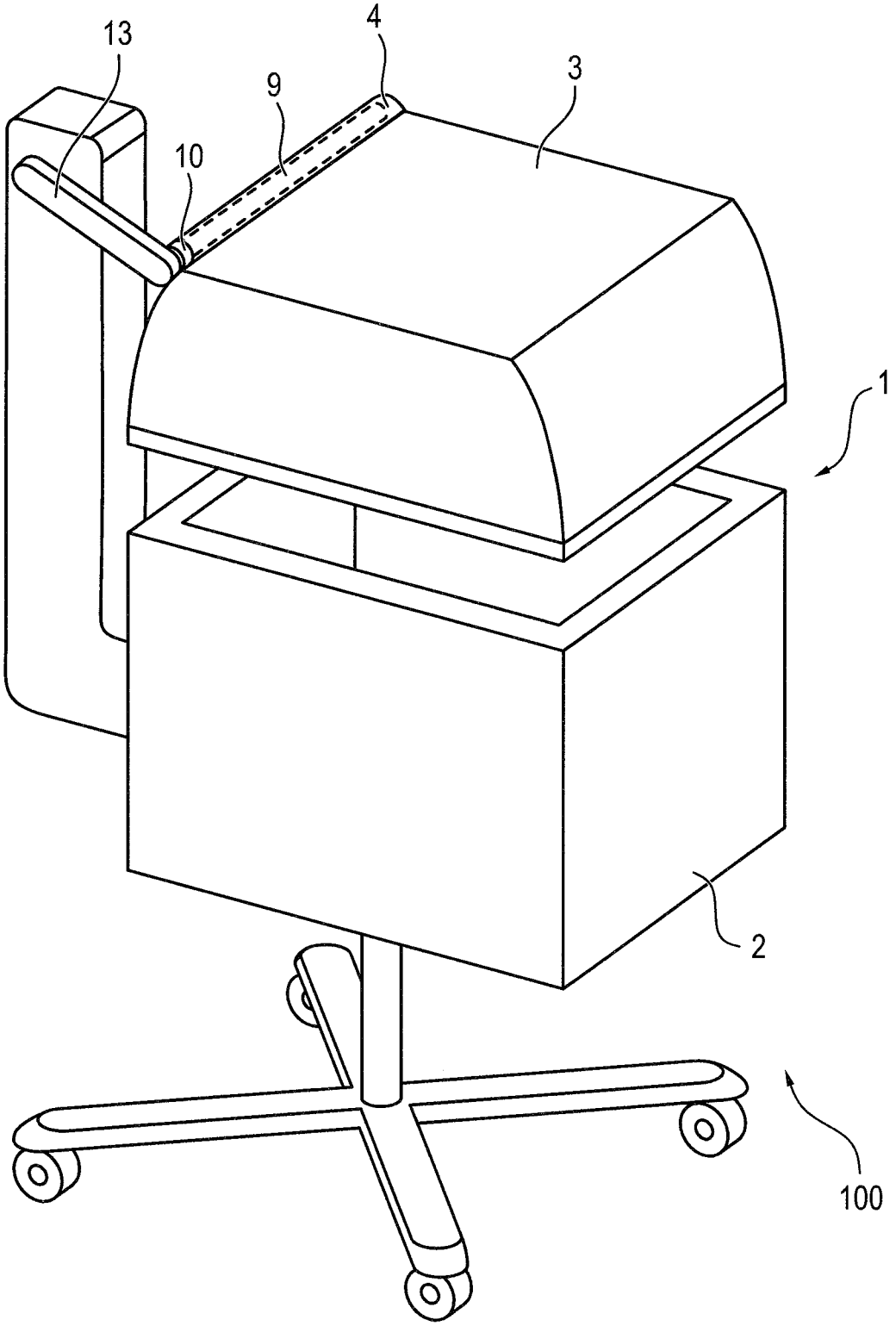
FIG. 1*b* is a schematic perspective view of the housing-hood system.

The housing-hood system 1 may, further, be a part of a thermotherapy device 100 (see FIG. 1*b*). The thermotherapy device 100 has a hood arm 13, which connects the hood 3 to the housing. The device 4 for connection and alignment is connected here to a hood fastening rod 9, wherein said hood fastening rod is connected to the hood arm 13. A patient (newborn) is then arranged in the housing 2 of the thermotherapy device 100. The hood 3 is then used to establish a closed system for the patient in order for the patient to have as little contact as possible with a poorly controllable or uncontrollable outside environment. The interior of the housing-hood system 1 in the thermotherapy device 100 can be controlled by means of additional devices. The correct alignment of the hood 3 in relation to the housing 2 is essential for securing the closed state of the housing-hood system 1 relative to the outside environment.

Figure 2A:
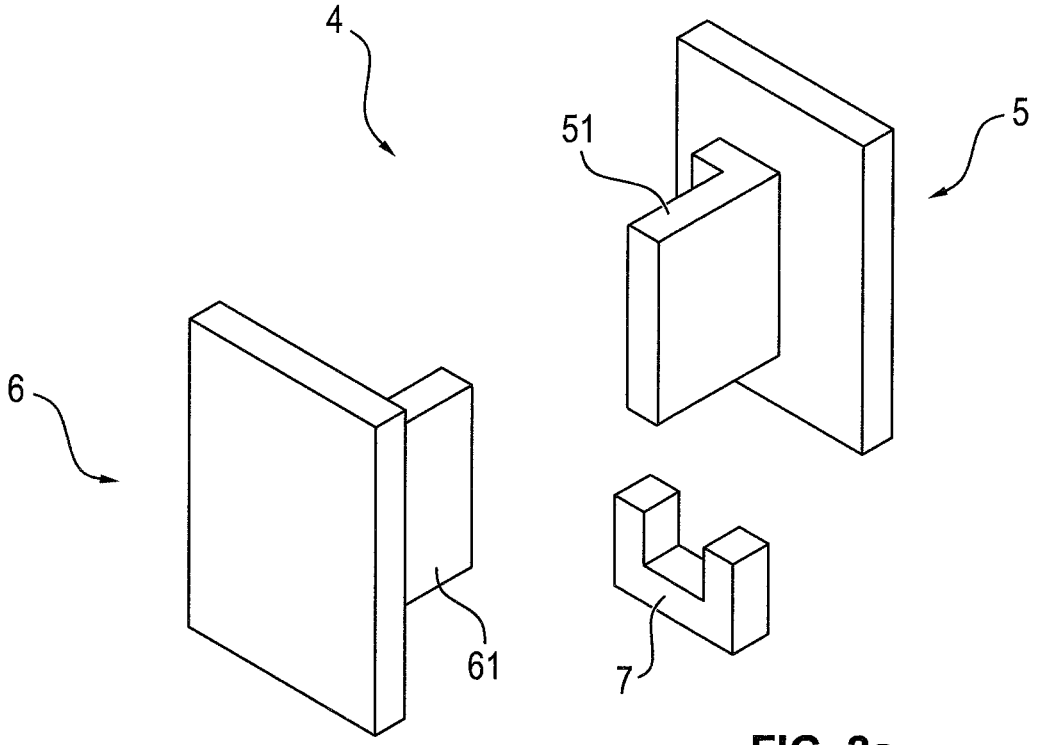
FIG. 2*a* is a schematic perspective view of a device for aligning and connecting a hood to a housing.

According to FIG. 2*a*, the device 4 comprises a first connecting piece 5, which has a clamp bearing element 51. The clamp bearing element 51 is permanently connected to the connecting piece 5.

The device 4 further has a second connecting piece 6, which comprises a lamella element 61. The lamella element 61 can be clamped on the clamp bearing element 51 by means of a clamping element 7 when the lamella element 61 is in contact with the clamp bearing element 51.

Figure 2B:
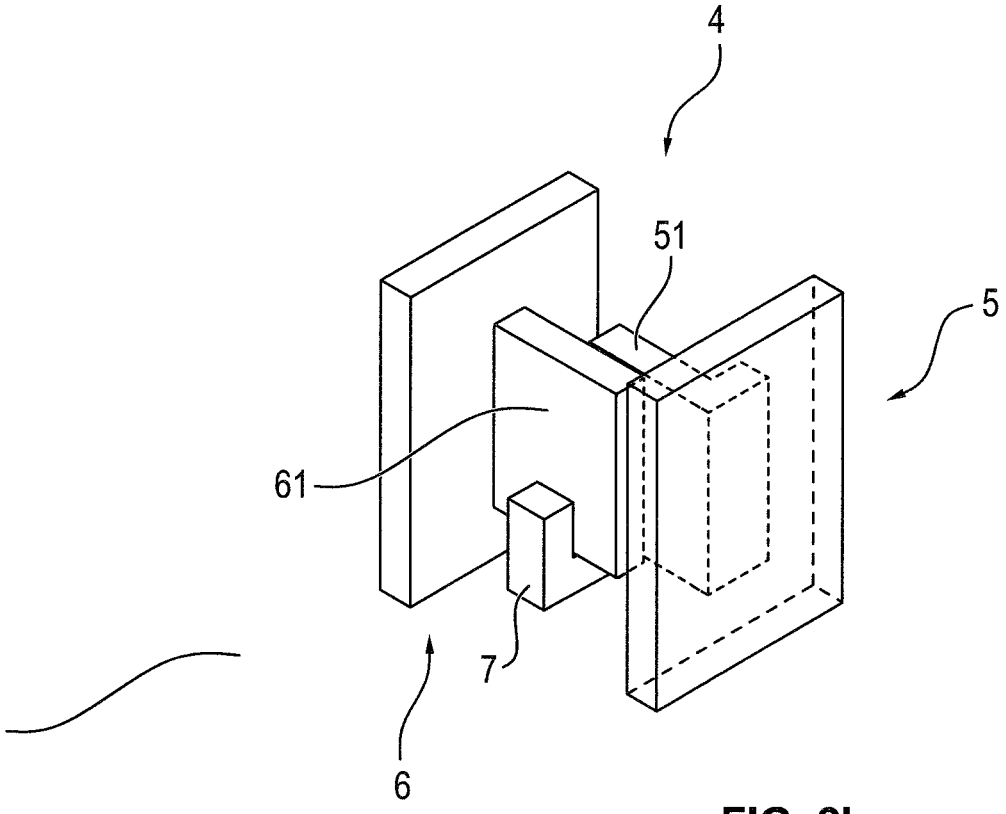
FIG. 2*b* is a schematic perspective view of a device for aligning and connecting a hood to a housing.

This state is shown in FIG. 2*b*. According to FIG. 2*b*, the lamella element 61 is arranged at the clamp bearing element 51 such that it can be displaced in a plane along the clamp bearing element before clamping with the element 7. According to FIG. 2*b*, it can be displaced along the plane of the sheet upwardly and downwardly as well as to the side in both directions without the lamella element 61 becoming separated from the clamp bearing element 51. When the position has been found for the lamella element 61, in which the hood 3 is aligned at the housing 2, clamping can be carried out by means of the clamping element 7, which causes the lamella element 61 to be clamped with the clamp bearing element 51. The lamella element 61 has no clearance for moving after the clamping. It is therefore clamped at the clamp bearing element 51 without clearance. Further, the first connecting piece 5 is permanently and immovably connected thereby to the second connecting piece 6.

The first connecting piece 5 and the second connecting piece 6 are configured for this to be permanently connected to a hood 3 and to an element of a housing 2. The first connecting piece 5 can be connected to the housing 2 and the connecting piece 6 to the hood 3. As an alternative, the first connecting piece 5 may be connected to the hood 3 and the second connecting piece 6 to the housing 2.

The clamping element 7 may be configured as a clip, as a screw or as a wedge.

Figure 3A:
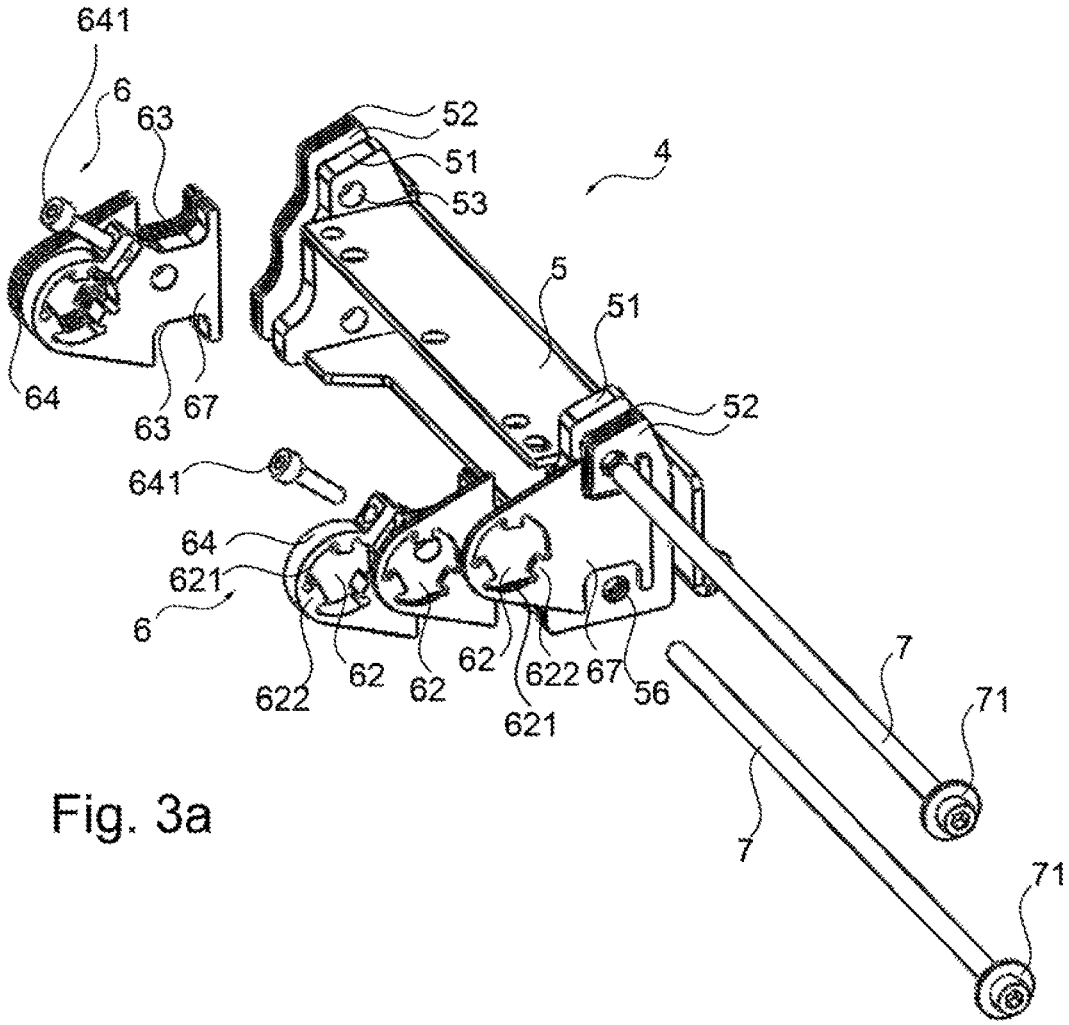
FIG. 3*a* is a schematic perspective view of an embodiment of the device with a plurality of lamella elements and additional lamellae.

According to a preferred embodiment, the clamping element 7 is configured as a clamping screw with a screw head 71, as is shown in FIG. 3*a*. The clamping element 7 is passed through a clamp bearing hole 53 through the clamp bearing element 51. The screw head 71 may be configured in the clamping element 7 configured as a clamping screw for coming into contact with the lamella element 61. The lamella element 61 can be pressed in this case onto the clamp bearing element 51 by means of the screw head 71 of the clamping element 7 by means of a nut on the opposite side of the clamp bearing element 51 and at the opposite opening of the clamp bearing hole 53 and thus clamped in this manner.

To increase the friction bringing about the clamping together, an intermediate lamella element 52 is provided, which brings the lamella element 61 into a sandwich position with the clamp bearing element 51. The lamella element 61 is now in contact by one side with the clamp bearing element 51 and by the other, opposite side with the intermediate lamella element 52. The intermediate lamella element 52 is connected to the first connecting piece 5. The first connecting piece 5 has for this a guide rail 55, in which a lamella guide element 54 of the intermediate lamella element 52 is guided. Based on the connection of the intermediate lamella element 52 to the first connecting piece 5, the lamella element 61 can be aligned in a plane between the clamp bearing element 51 and the intermediate lamella element 52, and a motion at right angles to the plane through the intermediate lamella element 52 and the clamp bearing element 51 is limited.

Figure 3B:
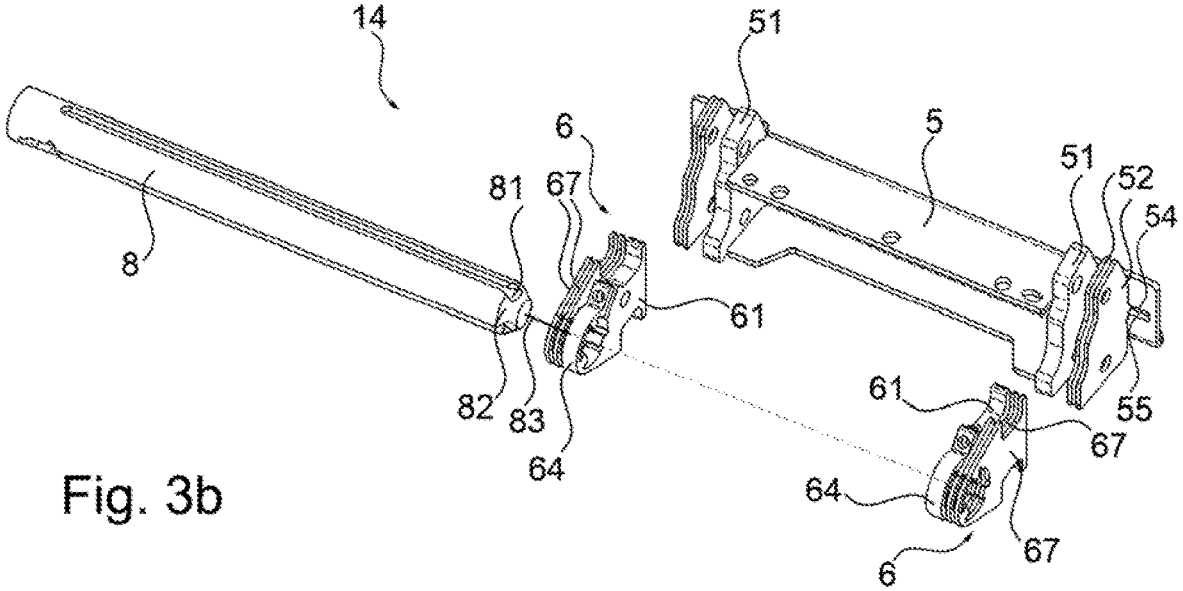
FIG. 3*b* is a schematic perspective view of an embodiment of the device with a plurality of lamella elements and additional lamellae.

The guide rail 55 now guides the intermediate lamella element 52 by means of the guide element 54 at right angles to the plane (see FIG. 3*b*). As a result, the intermediate lamella element 52 has clearance when the lamella element 61 is arranged in the intermediate space between the clamp bearing element 51 and the intermediate lamella element 52. This makes it easier to push in the lamella element 61.

The intermediate lamella element 52 is fastened here to the first connecting piece 5 such that a motion of the intermediate lamella element 52 at right angles to the guide rail 55 is not possible. Forces that act in this direction on the intermediate lamella element 52 are therefore transmitted to the first connecting piece 5.

In an alternative embodiment, the intermediate lamella element 52 can be connected by a material connection, such as welded to the guide rail 54. When clamping with the lamella element 61, the intermediate lamella element 52 is optionally bent toward the lamella element 621 and brought into frictional contact.

The first and second connecting pieces 5, 6 may have additional lamella elements 67 and additional intermediate lamella element 52. The additional lamella elements 67 and the intermediate lamella elements 52 are each arranged alternatingly with one another. An additional lamella element 67 and the lamella element 61 is then clamped either between a clamp bearing element 51 and an intermediate lamella element 52 or between two intermediate lamella elements 52. As an alternative, an additional lamella element 67 may further be clamped between a screw head 71 and a clamp bearing element 51 or an intermediate lamella element 52. The number of surfaces available for the clamping is thus greatly increased, so that reliable clamping is brought about by means of the clamping element 7 even in case of a weak clamping force.

Further, a lamella element 61 has a recess 63. If the lamella element 61 is arranged at a clamp bearing element 51, the recess 63 is arranged above the clamp bearing hole 53, i.e., the edge of the recess 63 extends at least partially around the clamp bearing hole 53. The edge of the recess 63 now extends around the clamp bearing hole 53 at a spaced location. If a clamping element 7 in the form of a clamping screw is arranged in the clamp bearing hole 53, the lamella element 61 continues to have clearance, with which the lamella element 61 can be moved at the clamp bearing element 51 in a plane. If a plurality of clamp bearing holes 53 and a plurality of clamping elements 7 are provided, the lamella element 61 has a plurality of recesses 63. One recess 63 each is arranged here above a clamp bearing hole 53.

An intermediate lamella element 52 has for this a clamping element hole 56, through which the clamping element 7 can be passed. The clamping element hole 56 is aligned here with the clamp bearing hole 53. A clamping screw acting as a clamping element 7 is now passed through the clamping element hole 56 to the clamp bearing hole 53 and is likewise passed through the clamp bearing hole 53. A recess 63 of a lamella element 61 is thus likewise arranged around the clamping element hole 56 of an intermediate lamella element 52.

The second connecting piece 6 has, further, a receiving part 62 for a hood fastening rod 9. The receiving part 62 may be configured in the form of an opening, whose edges have receiving grooves 621 and receiving tongues 622. This groove and tongue combination has a configuration fitting to a groove and tongue combination at the hood fastening rod 9, which likewise has grooves 91 and tongues 92. The hood fastening rod 9 is passed through the receiving part 62. Due to the groove and tongue combination, the hood fastening rod 9 can be rotated around a rod axis 93 of the hood fastening rod 9 within the receiving part 62. The hood fastening rod 9 can only be moved along the rod axis 93. Further, the hood fastening rod 9 can be tilted within the receiving part 62, i.e., the rod axis 93 of the hood fastening rod 9 is tilted out of its alignment. A hood fastening rod 9 can be fixed on the receiving part 62 by means of a fixing element 64, i.e., the tilting of the rod axis 93 of the hood fastening rod 9 or a motion of the hood fastening rod 9 along the rod axis 93 is no longer possible after the fixation.

The fixing element 64 is configured as a clamping ring element. The clamping ring element is braced with the hood fastening rod 9 by means of clamping screws 641.

The receiving part 62 and the lamella element 61 may be made in one piece, i.e., the receiving part 62 is connected in one piece to the lamella element 61 and is manufactured from the same part.

If a plurality of lamella elements 61, 67 are provided at the second connecting piece 6, it is sufficient if one of the lamella elements 61, which are grouped with the additional lamella elements 67, has a fixing element 64.

According to FIG. 3*b*, the connecting and aligning device 4 is configured as a preassembly system 14. The preassembly system 14 comprises for this a centering device 8, which is configured as a hood fastening rod 9. Contrary to a hood fastening rod 9, the centering device 8 is not connected to a hood arm 13. Thus, the centering device 8 is not a part of a housing-hood system 1.

A plurality of lamella elements 61, 67 of a device 4 can be centered by means of the centering device 8 relative to one another.

A centering device 8 is especially advantageous if a plurality of groups of lamella elements 61, 67 are provided. Each group of lamella elements 61, 67 has a lamella element 61 with a fixing element 64. The lamella elements 61,67 are first arranged for preassembly at the first connecting piece 5. The device 8 is now passed through the receiving part 62 of all existing lamella elements 61, 67, so that all lamella elements 61,67 are coupled with the centering device 8 and are centered relative to a centering rod axis 83 of the centering device 8.

The receiving parts 62 of the second connecting piece 6 are aligned based on the centering such that a hood fastening rod 9 can be passed through all receiving parts 62 of the second connecting piece 6 after removal of the centering device 8.

Both the hood fastening rod 9 and the centering device 8 have at their open end a cone end piece 84, 94, which facilitate the insertion of the hood fastening rod 9 and of the centering device 8 into the receiving parts 62. Further, a centering device bevel 85 and a hood fastening rod bevel 95, which facilitate the insertion of the receiving tongue 622 into the centering device groove 81 and into the hood fastening rod groove 91, are provided at the ends of the centering device groove 81 and of the hood fastening rod groove 91.

Figure 4A:
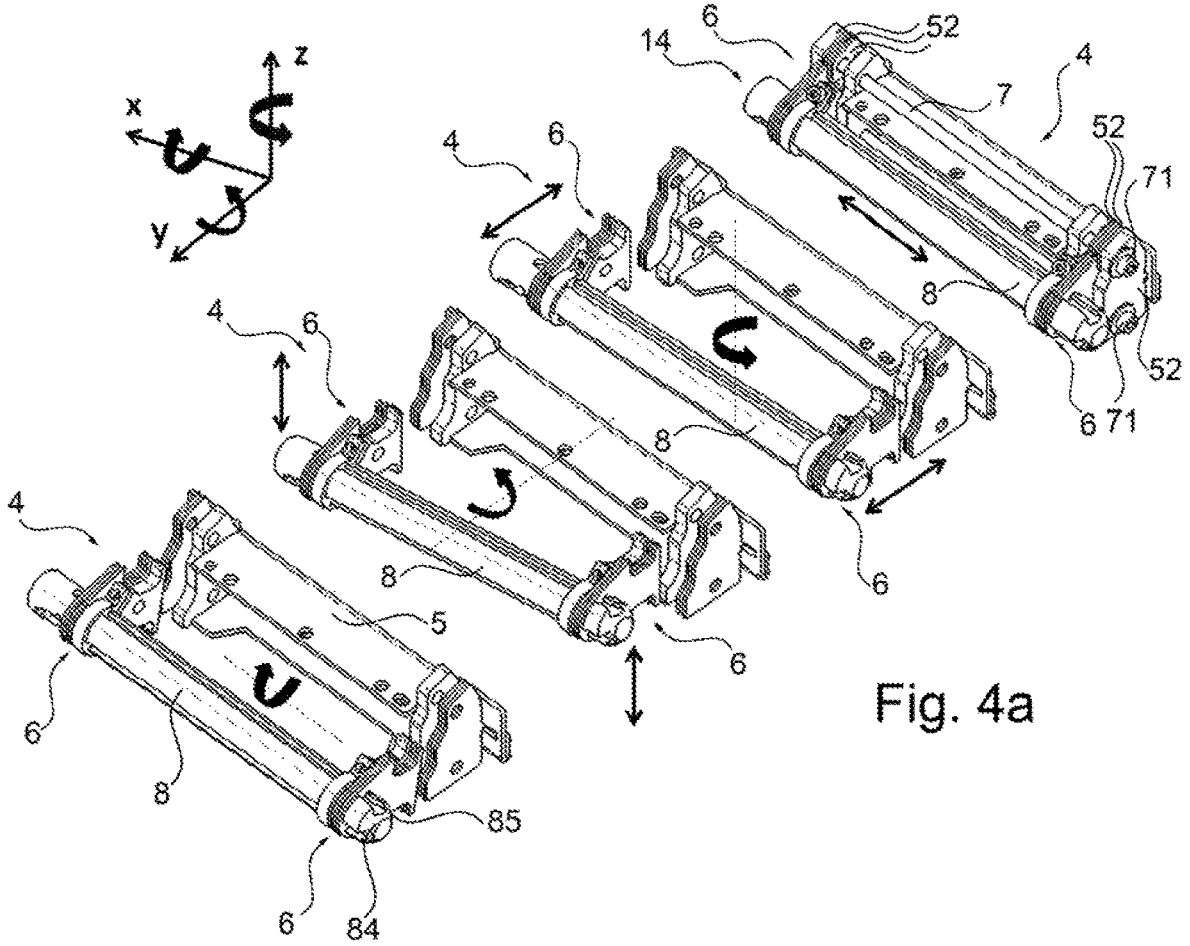
FIG. 4*a* is a sequence of schematic perspective views of the rotational degree of freedom and the translatory degree of freedom of the device.

A fully assembled preassembly system 14 is shown in the top right part of FIG. 4*a*. The clamping elements 7 act according to FIG. 4*a* on the intermediate lamella elements 52, which are arranged on the outside and which act, in turn, on the clamp bearing element 51 via alternatingly arranged, additional lamella elements 67 and via the additional intermediate lamella elements 52. The clamping force of the clamping elements 7 on the lamella elements 61,67 is distributed homogeneously with this arrangement.

Further, FIG. 4*a* shows the possible degrees of freedom that the second connecting piece 6 has relative to the first connecting piece 5. It further shows the degrees of freedom that a hood fastening rod 9 that is replaced in FIG. 4*a* by a centering 8 comprises. The degrees of freedom that are made possible by the lamella elements 61, 67 are fixed by the clamping by means of the clamping element 7. The degrees of freedom that a hood fastening rod 9 or a centering device 8 has are fixed by the fixing element 64.

Figure 4B:
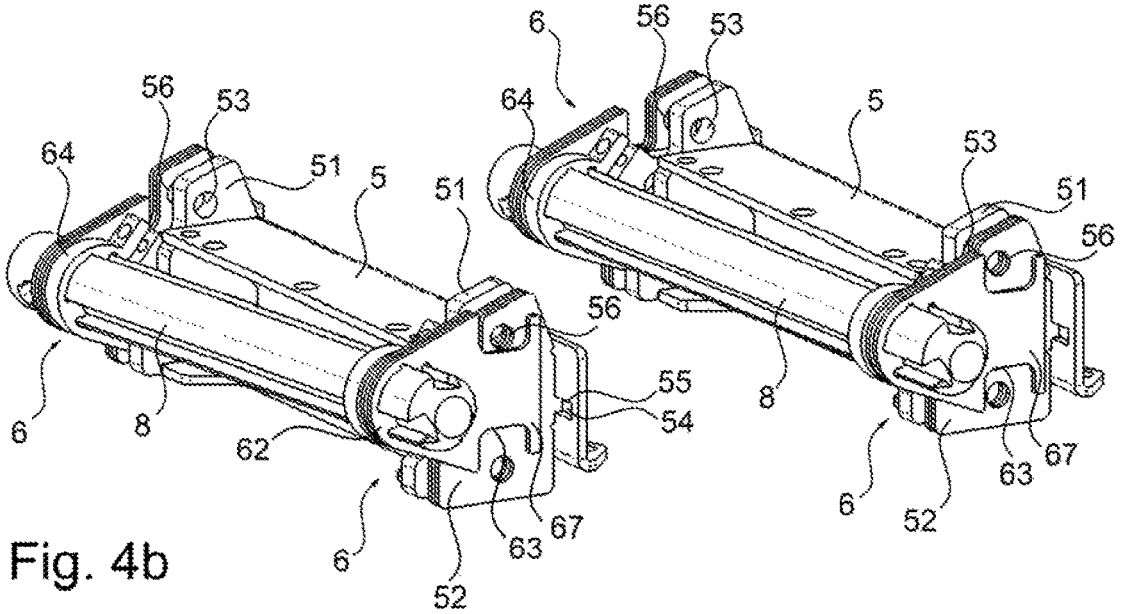
FIG. 4*b* is a sequence of schematic perspective views of the rotational degree of freedom and the translatory degree of freedom of the device.
Figure 6:
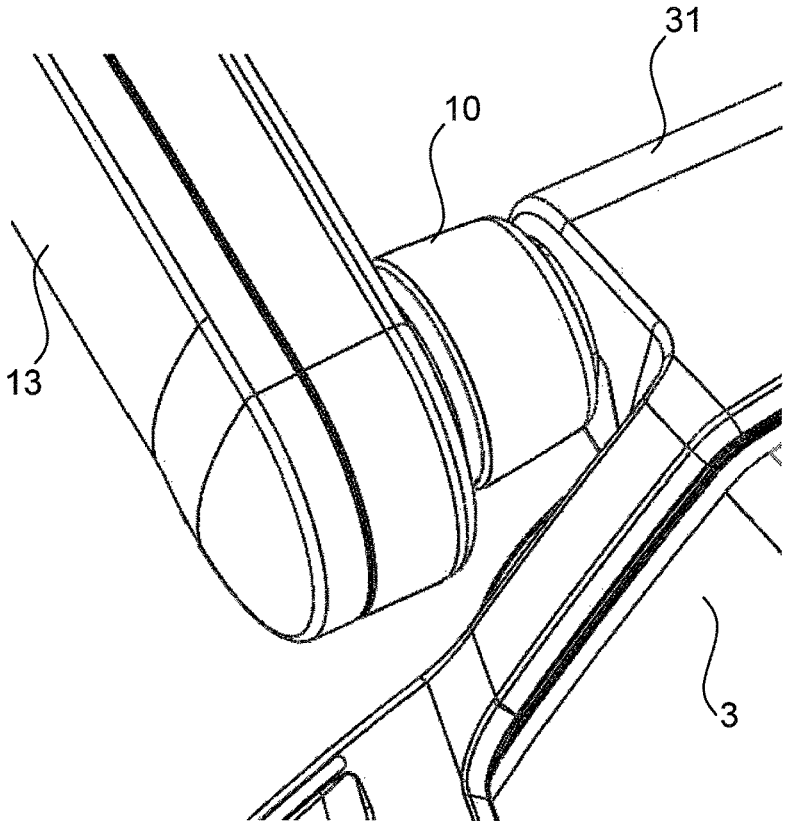
FIG. 6 is a schematic perspective view for a device with a cover element.

A detailed view of the displaced additional lamella elements 67 relative to the intermediate lamella elements 52 of the first connecting piece 5 is shown in FIG. 4*b*. Tilting of the second connecting piece 6 relative to the first connecting piece 5 out of a horizontal plane is shown on the left-hand side. Tilting of the second connecting piece 6 relative to the first connecting piece 5 within the horizontal plane is shown on the right-hand side of FIG. 6. It can clearly be seen that the edges of the recesses 63 are located at least partly at spaced locations from the clamping element holes 56 and from the clamp bearing hole 53 and extend at least partly around the clamp bearing hole 53 and around the clamping element holes 56 in both tilted states. The additional lamella elements 67 therefore have clearance in one plane relative to the intermediate lamella elements 52 and the clamp bearing element 51.

To mount the device 4 on a housing-hood system 1, the device 4 with the centering device 8 is fastened on a hood 3 by means of fastening elements 11. The centering device 8 can then be removed from the device 4 and the device 4 can be pushed together with the hood 3 onto a hood fastening rod 9. The pushing onto is facilitated by the hood fastening rod cone end piece 94 and the hood fastening bevels 95.

Figure 5:
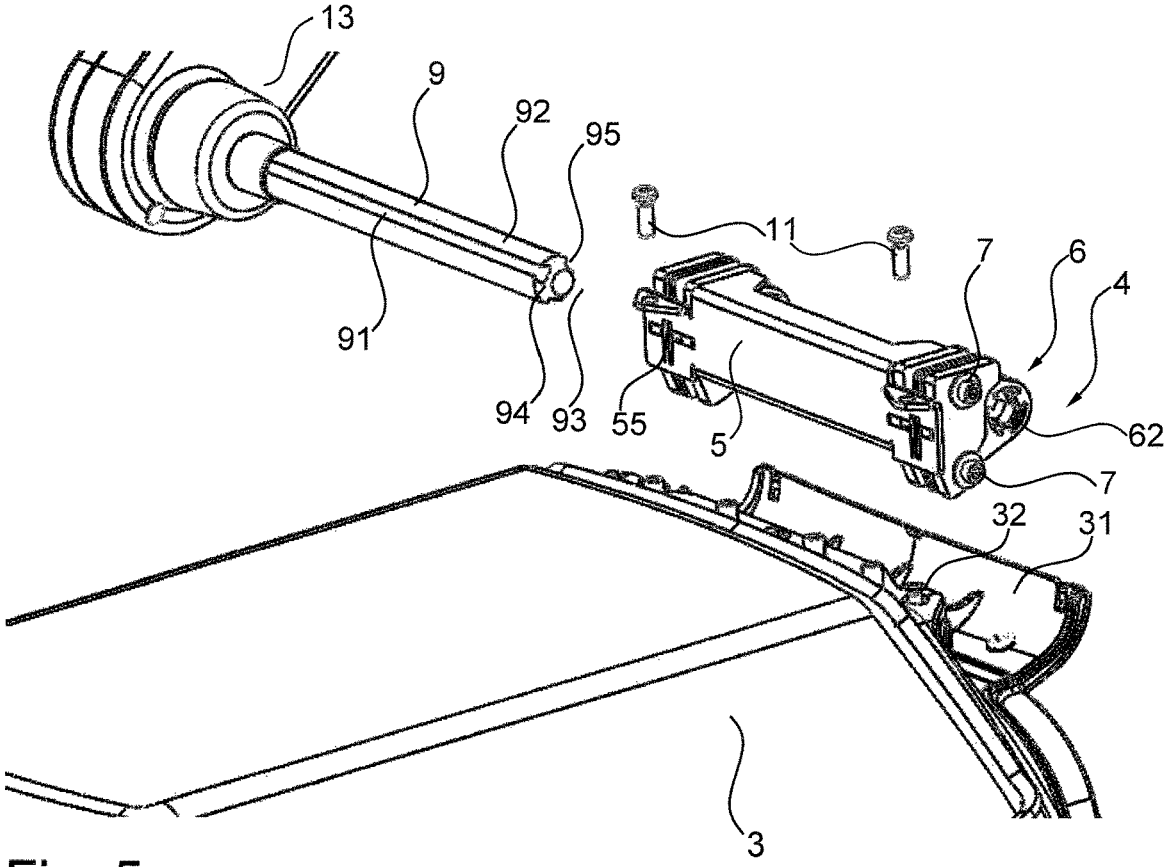
FIG. 5 is a schematic perspective view of the mounting of the device on a housing-hood system.

As an alternative, the centering device 8 can be removed from the receiving parts 62 of the second connecting piece 6 for mounting the device 4 on a housing-hood system 1 from the preassembly system 14. Clamping elements 7 are not yet unclamped now. The device 4 is then pushed with the second connecting piece 6 according to FIG. 5 onto a hood fastening rod 9 of a hood arm 13, which is connected to a housing 2 of a housing-hood system 1. Further, the first connecting piece 5 is connected to a hood 3 of a housing-hood system 1 by means of fastening elements 11. To couple the device 4, the hood 3 may have coupling elements 32, which form a mount of the hood 3 for the device 4.

The hood fastening rod 9 can be passed in a simple manner through the receiving parts 62 of the second connecting piece 6, because the centering device 8 had centered the receiving parts 62 in relation to one another.

After the hood fastening rod 9 had been passed through the receiving parts 62 of the second connecting piece 6, the hood 3 is arranged in the position to be aligned at the housing 2. The clamping elements 7 are then unclamped, so that the lamella elements 61, 67 can move freely relative to the first connecting piece 5 in one plane. The second connecting piece 6 can thus be aligned relative to the first connecting piece 5. The hood 3 aligns itself automatically into the correct position relative to the housing 2 itself.

The clamping element 7 is then used again to clamp the lamella elements 61, 67, so that a motion of the second connecting piece 6 relative to the first connecting piece 5 cannot take place any longer. This is then followed by the fixation of the hood fastening rod 9 in the receiving parts 62 by means of tightening the clamping ring screws 641 on the fixing elements 64. All six degrees of freedom of the hood 3 relative to the housing 2 are thus set, so that the alignment of the hood 3 relative to the housing 2 has concluded.

The device 4 may further be covered by means of a cover part 31 after the alignment, so that the device 4 is protected from contamination and accidental actuation of the clamping elements 7 or fixing elements 64. In addition, the cleaning and disinfection of the hood 3 is made possible by the cover part 31, without the device 4 having to be exposed for connecting and aligning a hood 3.

The clamping elements 7 and the clamping ring screws 641 are accessible from the outside through the conable service openings, not shown, in the cover part 31 and in the additional covers of the device 4. Further readjustments can thus still take place without a major effort after the adjustment and the assembly of the housing-hood system.

Since the hood fastening rod 9 can be displaced within the receiving parts 62 along the rod axis 93 during the alignment of the hood 3, the hood fastening rod 9 is free between the hood arm 13 and the device 4. To prevent contaminants or clothes or body parts of the operating staff from entering the device 4 via this free area of the hood fastening rod 9, a cover element 10 is provided, which covers the free area of the hood fastening rod 9 (cf. FIG. 6). The cover element 10 is supported here on the hood arm 13 with a spring force acting along the axis of the hood fastening rod 9. Further, the cover element 10 is mounted longitudinally displaceably on the hood fastening rod 9. It is thus pushed along the hood fastening rod 9 to the cover part 31 of the device 4 at any time, so that the lateral opening of the cover part 31 is closed by the cover element 10 at any time.

In case the hood 3 has to be detached from the housing 2 again, it is only necessary to unclamp the fastening elements 11 or the fixing elements 64 by means of the clamping ring screws 641. The hood 3 with the device 4 can be removed in this case from the hood fastening rod 9. The hood 3 can then be repaired, serviced or replaced independently from the housing 2.

A realignment of the hood 3 with the housing 2 can readily be performed by unclamping the clamping element 7. The hood 3 is then placed, as was described above, on the new housing 2 or the new hood 3 is placed on the old housing 2 and the clamping element 7 is used to clamp and fix the alignment of the hood 3. Further, the fixing element 64 will then also be used to fix the hood fastening rod 9 on the device 4.

While specific embodiments of the invention have been shown and described in detail to illustrate the application of the principles of the invention, it will be understood that the invention may be embodied otherwise without departing from such principles.

APPENDIX

| List of Reference Numbers | |
|---|---|
| 1 | Housing-hood system |
| 2 | Housing |
| 3 | Hood |
| 4 | Connecting and aligning device |
| 5 | First connecting piece |
| 6 | Second connecting piece |
| 7 | Clamping element |
| 8 | Centering device |
| 9 | Hood fastening rod |
| 10 | Cover element |
| 11 | Fastening element |
| 13 | Hood arm |
| 14 | Preassembly system |
| 31 | Cover part |

APPENDIX-continued

| List of Reference Numbers | |
|---|---|
| 32 | Coupling element |
| 51 | Clamp bearing element |
| 52 | Intermediate lamella element |
| 53 | Clamp bearing hole |
| 54 | Lamella guide element |
| 55 | Guide rail element |
| 56 | Clamping element hole |
| 61 | Lamella element |
| 62 | Receiving part |
| 63 | Recess |
| 64 | Fixing element |
| 71 | Screw head |
| 81 | Centering device groove |
| 82 | Centering device tongue |
| 83 | Centering rod axis |
| 84 | Centering device cone end piece |
| 85 | Centering device bevel |
| 91 | Hood fastening rod groove |
| 92 | Hood fastening rod tongue |
| 93 | Rod axis |
| 94 | Hood fastening rod cone end piece |
| 95 | Hood fastening rod bevel |
| 100 | Thermotherapy device |
| 621 | Receiving groove |
| 622 | Receiving tongue |
| 641 | Clamping ring screw |

What is claimed is:

1. A device for aligning and connecting a hood with a housing, the device comprising:

a first connecting piece with a clamp bearing element;

a second connecting piece comprising a lamella element, wherein the lamella element is arranged movably along the clamp bearing element; and a clamping element configured for a clearance-free clamping of the lamella element with the clamp bearing element, wherein the clamping element is configured for a detachable clamping of the lamella element with the clamp bearing element wherein with the device connecting the hood with the housing, a position of the hood relative to the housing is adjusted by releasing the clearance-free clamping of the lamella element with the clamp bearing element by the clamping element, adjusting a position of the lamella element relative to the clamp bearing element to an aligned position and the aligned position of the hood relative to the housing is set with a subsequent clearance-free clamping of the lamella element with the clamp bearing element by the clamping element.

2. A device in accordance with claim 1, wherein the lamella element has clearance in a single plane in a state in which the lamella element is arranged at the clamp bearing element, whereby the lamella element is displaced in the single plane relative to the clamp bearing element.

3. A device in accordance with claim 1, wherein:

the second connecting piece has a receiving part for receiving a hood fastening rod; and the receiving part is connected to the lamella element.

4. A device in accordance with claim 3, wherein:

the receiving part receives the hood fastening rod without clearance; and a fixing element, comprising a clamping ring element, is arranged at the receiving part for a clearance-free fixation of the hood fastening rod at the second connecting piece.

5. A device in accordance with claim 3, wherein the receiving part has a receiving groove and a receiving tongue, which are configured fittingly to a groove and tongue combination of the hood fastening rod.

6. A device in accordance with claim 3, wherein the receiving part is made as one piece with the lamella element.

7. A device in accordance with claim 1, wherein:

the first connecting piece has the clamp bearing element and another clamp bearing element to provide clamp bearing elements located at mutually spaced locations from one another; and the second connecting piece has the lamella element and another lamella element to provide lamella elements located at mutually spaced locations from one another, the lamella elements each associated with one of the clamp bearing elements.

8. A device in accordance with claim 1, wherein:

the first connecting piece further comprises an intermediate lamella element with a lamella guide element, the lamella guide element guided at a guide rail element at the first connecting piece;

the intermediate lamella element is clamped by the clamping element to the lamella element and the intermediate lamella element is connected to the guide rail element.

9. A device in accordance with claim 1, wherein:

the first connecting piece further comprises an intermediate lamella element;

the second connecting piece has at least one additional lamella element, the at least one additional lamella element of the second connecting piece arranged movably at the intermediate lamella element of the first connecting piece; and the at least one additional lamella element is clamped without clearance with the intermediate lamella element of the first connecting piece by means of the clamping element.

10. A device in accordance with claim 1, wherein:

the clamping element is configured as a clamping screw; and the clamp bearing element has a clamp bearing hole for receiving a part of the clamping element.

11. A device in accordance with claim 10, wherein:

the first connecting piece further comprises an intermediate lamella element;

the intermediate lamella element has a clamping element hole aligned with the clamp bearing hole for receiving the clamping screw.

12. A device in accordance with claim 10, wherein the lamella element has a recess with an edge extending at least partly circumferentially around the clamp bearing hole in a state in which the lamella element is arranged at the clamp bearing element.

13. A preassembly system comprising:

an aligning and connecting device for connecting a hood with a housing, the aligning and connecting device comprising:

a first connecting piece with a clamp bearing element;

a second connecting piece comprising at least two lamella elements, wherein the lamella elements are arranged movably along the clamp bearing element;

a clamping element configured for clearance-free clamping of one of the lamella elements with the clamp bearing element, wherein the clamping element is configured for a detachable clamping of the lamella element with the clamp bearing element wherein with the aligning and connecting device connecting the hood with the housing, a position of the hood relative to the housing is adjusted by releasing the clearance-free clamping of the lamella element with the clamp bearing element by the clamping element, adjusting a position of the lamella element relative to the clamp bearing element to an aligned position and the aligned position of the hood relative to the housing is set with a subsequent clearance-free clamping of the lamella element with the clamp bearing element by the clamping element; and a centering device centering the lamella elements.

14. A preassembly system in accordance with claim 13, wherein the centering device has a configuration corresponding to a hood fastening rod.

15. A preassembly system in accordance with claim 14, wherein:

the centering device has a centering device cone end piece;

the centering device has a centering device groove extending along a longitudinal direction of the centering device;

a centering device bevel is arranged at the centering device cone end piece.

16. A thermotherapy device comprising:

a housing;

a hood; and an aligning and connecting device connecting the housing to the hood for aligning and connecting the hood to the housing, wherein the aligning and connecting device comprises:

a first connecting piece with a clamp bearing element;

a second connecting piece comprising a lamella element, wherein the lamella element is arranged movably along the clamp bearing element; and a clamping element configured for clearance-free clamping of the lamella element with the clamp bearing element, wherein the clamping element is configured for a detachable clamping of the lamella element with the clamp bearing element wherein with the aligning and connecting device connecting the hood with the housing, a position of the hood relative to the housing is adjusted by releasing the clearance-free clamping of the lamella element with the clamp bearing element by the clamping element, adjusting a position of the lamella element relative to the clamp bearing element to an aligned position and the aligned position of the hood relative to the housing is set with a subsequent clearance-free clamping of the lamella element with the clamp bearing element by the clamping element.

17. A thermotherapy device in accordance with claim 16, wherein the housing has a hood arm with a hood fastening rod.

18. A thermotherapy device in accordance with claim 17, wherein the hood fastening rod comprises a hood fastening rod cone end piece and a hood fastening rod groove extending along a longitudinal direction of the hood fastening rod with a hood fastening rod bevel arranged at the hood fastening rod cone end piece.

19. A thermotherapy device in accordance with claim 17, further comprising a cover element arranged on the hood fastening rod and supported with spring force on the hood arm.

* * * * *